United States Patent [19]

Magnifico et al.

[11] Patent Number: 4,749,365

[45] Date of Patent: Jun. 7, 1988

[54] INSULATION DISPLACEMENT TERMINAL

[76] Inventors: George Magnifico, 420 Woodmere Blvd., Woodmere, N.Y. 11598; Paul Fitting, 34 S. 24th St., Camphill, Pa. 17011

[21] Appl. No.: 1,695

[22] Filed: Jan. 9, 1987

[51] Int. Cl.[4] ..... H01R 4/24

[52] U.S. Cl. ..... 439/396

[58] Field of Search ..... 339/97 R, 97 P, 98, 339/99 R

[56] References Cited

U.S. PATENT DOCUMENTS 4,012,102 3/1977 Cherney et al. ..... 339/97 P
4,106,837 8/1978 Paluch ..... 339/98

FOREIGN PATENT DOCUMENTS 3,116,731 11/1982 Fed. Rep. of Germany .... 339/97 R
2019118 10/1979 United Kingdom ..... 339/97 R

*Primary Examiner*—Joseph H. McGlynn
*Attorney, Agent, or Firm*—Hopgood, Calimafde, Kalil, Blaustein & Judlowe

[57] ABSTRACT

An insulation displacement connector or terminal is comprised of inner and outer beams forming a slot. A coined area of the common portion between the inner and outer beams forces the inner beams toward each other and improves slot tolerance and spring force. The terminal may be provided with two slotted ends to permit the interconnection of different diameter cables or wires.

8 Claims, 2 Drawing Sheets

INSULATION DISPLACEMENT TERMINAL

BACKGROUND OF THE INVENTION

The present invention relates generally to an insulation displacement connector or terminal used to electrically connect wires and cables. More particularly, it relates to a terminal having an improved internal cantilevered beam.

It has been known in the art that insulated wire can be terminated or connected by means of a solderless terminal without first stripping away the insulation. To this end, it has been known that the insulation of a wire could be skived away by forcing the wire into a terminal slot having a dimension less than the combined diameter of the wire and its insulation. The insulation having thereby been skived, the slot deforms and grips the bare wire to provide for both mechanical and electrical contact. Early versions of such insulation displacement terminals were employed in terminal blocks used for interconnecting telephone system wiring. Other versions have been used with round conductor ribbon cable.

Insulation displacement connectors have been extensively used for terminating conductors having soft plastic insulation. To a lesser extent, the solderless prior art connectors have been applied to solid magnet wire having a harder, tougher insulation.

Problems, however, have arisen with respect to the known insulation displacement connectors. For example, the terminals often fail to connect conductors having ranges any larger than one or two AWG sizes. This limitation of range has required the manufacture, purchase and storage of several sizes of connectors when a user is presented with the problem of connecting cables having many AWG sizes.

Another limitation of the prior art connectors has been the difficulty of achieving consistent displacement of the harder, tougher insulation or coating commonly used on solid magnet wire. The connection problems associated with magnet wire are amplified because these wires normally have small diameters. Consequently, it is necessary for the insulation displacement connector to have appropriate means to displace the tough magnet wire insulation, but yet not cut the wire itself or unacceptably weaken it. The narrow diameter of the magnet wire also creates manufacturing problems with slot tolerances.

It has also been difficult to utilize a single connector to interconnect magnet wire to larger diameter solid or stranded wire.

Finally, another problem has been the difficulty of maintaining a gas-tight interface at the point of terminal and wire contact.

SUMMARY OF THE INVENTION

In accordance with the present invention, there is provided an insulation displacement connector having two slotted ends. The slots have a precise tolerance and spring force as a result of coining the common area between the inner and outer beams so that the inner beams are forced toward each other. The inner beams will generate a spring force when they are directed outward by a wire which is larger than the slot.

It is an object of the present invention to provide an insulation displacement connector which will accept a range of AWG sizes.

Another object of the invention is to provide an improved connector for connecting magnet wire and to interconnect magnet wire with a range of larger diameter stranded or solid wires using a single terminal.

A still further object of the invention is to improve slot tolerances which permit the acceptance of smaller diameter wire.

Other objects and various features of novelty and invention will be pointed out or will occur to those skilled in the art upon consideration of the following specification in conjunction with the accompanying diagrams.

BRIEF DESCRIPTION OF THE DRAWINGS

The invention will be better understood after reading the following detailed description of the presently preferred embodiment thereof with reference to the appended drawings in which, for illustrative purposes only.

DESCRIPTION OF THE PREFERRED EMBODIMENT

Figure 1:
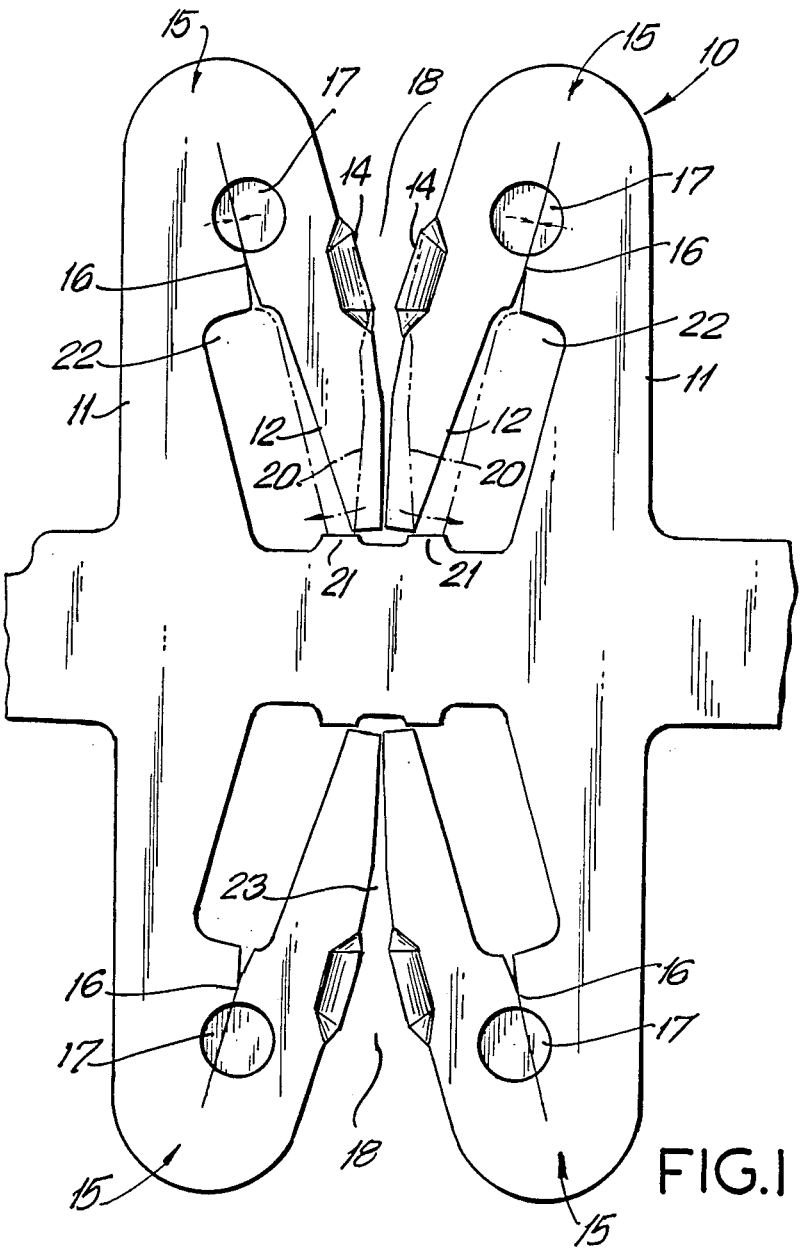
FIG. 1 is a front view showing one preferred embodiment of the terminal of the invention.
Figure 2:
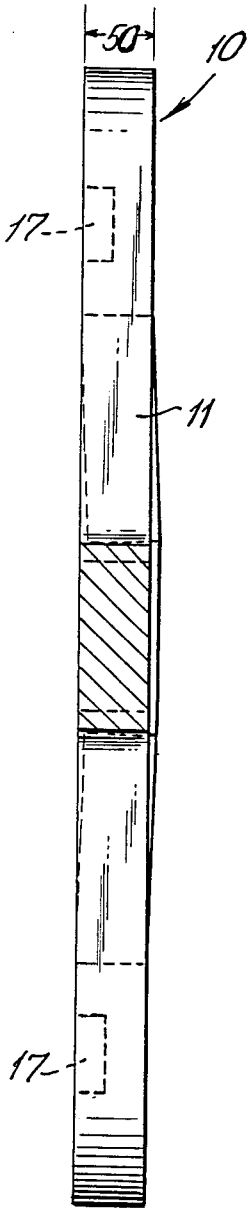
FIG. 2 is a side view of the terminal shown in FIG. 1.

Reference should now be had to the drawings wherein the same reference numerals are used throughout to designate the same or similar parts. In FIGS. 1 and 2 is shown a terminal designated generally by the reference numeral 10. The terminal includes outer beams 11 and inner beams 12. The inner beams have cutting blades 14. The inner and outer beams share a common expanse 15. A small slit 16 partially divides the inner and outer beams at expanse 15. A coined area 17 is also located in common expanse 15. The inner beams 12 form receiving slots 18.

Figure 3:
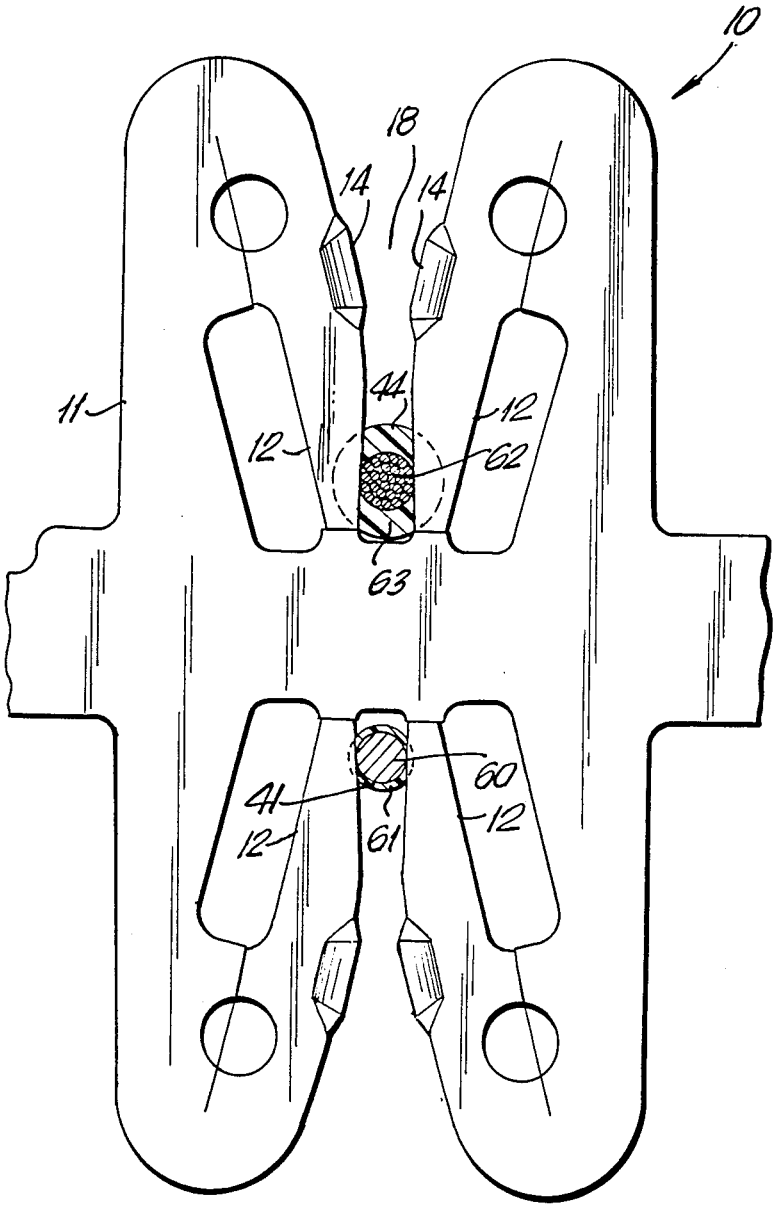
FIG. 3 is another front view of the terminal shown in FIG. 1, but the view also shows the connection of a magnet wire to stranded wire.

The outer beams 11 are stiff cantilever springs which create high forces on the insulation of a wire, such as 41 or 44 of FIG. 3, inserted in slot 18. The high force assures displacement of the insulation as the wire is forced into the slot 18 and through the cutting blades 14. Although the outer beams are essentially stiff to permit a skiving of wire insulation, some flexibility is necessary to permit the connection of a range of wire sizes.

The inner beams 12 are flexible springs which maintain gas tight electrical connections over a range of wire diameters. Furthermore, the inner beams operate in an elastic range so that these beams 12 flex to compensate for ordinary vibrations and other factors, thereby maintaining the needed force at the contact interface to assure electrical and mechanical reliability. Any creep of metals which might take place under high temperature exposure over significant time periods will be compensated for by the inner spring beam 12 with no significant loss of pressure.

Blades 14 are formed at the slot opening by coining the original thickness of the terminal 10 to a smaller thickness at the opening of slot 18. Interestingly, it has been found that the action of the cutting blades 14 is only needed for the larger size magnet wires.

A significant aspect of the invention is the coined area 17. The terminal 10 is generally made from a spring-tempered copper alloy. The use of this alloy makes it very difficult to provide a wire receiving slot in the terminal 10 which is smaller than the thickness 50 of the terminal. Precise narrow slots are particularly necessary for connecting magnet wire of small diameters having tough insulation. Moreover, punches for such narrow slots generally do not stand up very well for high speed stamping operations. These problems are overcome by the coined areas 17. During manufacture, the inner and outer beams are initially formed by punching out a portion of material at 22. A wide wire receiving slot 18 is formed by similarly punching out a portion of material at 23. Dotted lines 20 indicate the location of the inner beams 12 when punched. During the manufacturing operation, the inner beams 12 are sheared at 21 from the central portion of terminal 10. Consequently, the inner beams are allowed to float and attain the needed flexibility. The problem at this point of manufacture is that the slot 18 created by the inner beams is too wide. In order to close the slot 18 and create a force pushing the inner beams toward each other, a slit 16 is formed in the common expanse 15 of the inner and outer beams, and a portion of the expanse 15 is coined at 17. The coining compresses the metal at 17 thereby forcing the metal at coining 17 to flow into slit 16, and forcing the inner beams toward each other. Thus, the coining permits a narrower slot 18 to be manufactured, such slot having improved connecting features. In order to connect solid insulated magnet wire to stranded, insulated wire, the terminal 10 is formed in a mirror type image so that slots 18 are formed in both the upper and lower portions of terminal 10.

FIG. 3 shows the connection of a solid magnet wire 41 to stranded wire 44. Magnet wire 41 has a solid conducting portion 60 surrounded by insulation 61. Wire 44 has multiple conducting strands 62 encased in insulation 63. In FIG. 3, insulation 61 and 63 of wires 41 and 44, respectively, have been skived away by internal beams 12 and their cutting edges 14. The skiving allows electrical contact to be made between the solid conducting portion 60, multiple conducting strands 62 and the internal beams 12.

Figure 4:
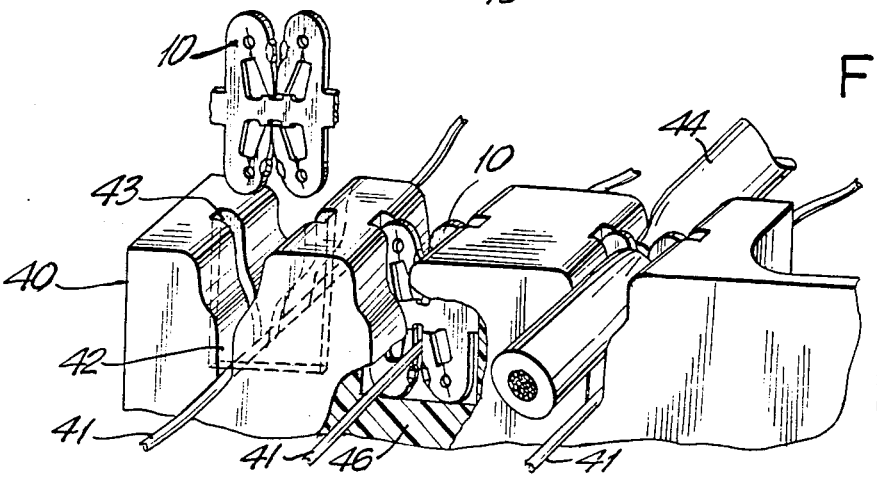
FIG. 4 is a perspective view, with partial cut-away, of one embodiment of the terminal and its associated receiving housing.

As shown in FIG. 4, typical use of terminal 10 is as follows. A housing or bobbin 40 may be used in conjunction with an apparatus containing a coil wound with magnet wire, such as 41. A free end of the magnet wire 41 is positioned across a slot 42 formed in bobbin 40. A further slot 43 is formed in bobbin 40 to accept terminal 10. By either manual or automatic means, the terminal 10 is forced downward into slot 43 so that the magnet wire 41 is forced into a slot 18 of terminal 10. The cutting edges 14 of terminal 10 cut the insulation of magnet wire 41, and inner beams 12 thereafter hold the magnet wire 41 and maintain electrical contact. Cutaway portion 46 illustrates the positioning of terminal 10 in bobbin 40. Once terminal 10 is positioned in slot 43, another wire, such as stranded wire 44, may be connected to terminal 10. The larger stranded wire 44 is forced down into the top slot 18 of terminal 10, as shown in FIGS. 3 and 4, thereby completing the connection of larger stranded wire 44 to smaller diameter magnet wire 41.

An important consideration in the use of insulation displacement connectors is the terminal interface where a wire contacts the terminal. It has been known that a base-metal connector, which does not use precious metal plating, such as gold or palladium, must be free of oxides or other corrosive products when it is manufactured. Furthermore, the connection interface should be gas-tight in order to prevent oxides and other substances from forming at the interface.

If the interface is not gas-tight throughout its expected lifetime, molecules of oxygen and other gases may enter the interface to cause a slow, gradual buildup of corrosion. The corrosion will reduce the area of electrical contact, thereby causing a gradual rise of contact resistance. The increased contact resistance may then cause a temperature rise at the contact interface and ultimately cause a connection failure.

The flexible inner beams 12 of the present invention greatly reduce, if not eliminate, the problem of corrosion, by essentially maintaining a gas-tight interface. The coined area of terminal 10 improves the action of flexible inner beams 12.

Having described the invention with reference to the presently preferred embodiments thereof, it will be understood that various changes may be made in the construction of the article without departing from the true spirit and scope of the invention as defined in the appended claims.

What is claimed is:

1. An insulation displacement terminal comprised of at least two outer beams and at least two inner beams forming a wire receiving slot, one each of said outer beams and said inner beams sharing a common portion having a coined area.

2. An insulation displacement terminal according to claim 1, wherein said common portion and coined area are slitted.

3. An insulation displacement terminal according to claim 1, wherein a section of said inner beams at an opening of said receiving slot has coined cutting edges.

4. An insulation displacement terminal according to claim 1, wherein the terminal has an upper set of said inner and outer beams and a lower set of said inner and outer beams, said upper and lower sets forming upper and lower wire receiving slots.

5. A method of manufacturing an insulation displacement terminal, comprising the steps of:

(a) forming inner and outer beams by punching out a portion of material between each of said inner and outer beams;

(b) forming a wire receiving slot by punching out a portion of material between two of said inner beams;

(c) shearing one end of each of said inner beams from a central portion of said terminal; and (d) coining a portion of a common area shared by one each of said inner and outer beams.

6. The method of claim 5, wherein a section of said common area is slitted.

7. The method of claim 5, wherein a section of said adjacent inner beams at said wire receiving slot are coined to form a cutting edge.

8. The method of claim 5, wherein the terminal has both upper and lower wire receiving slots.

* * * * *